United States Patent [19]

Beke

[11] Patent Number: 4,486,911

[45] Date of Patent: Dec. 11, 1984

[54] AUTOMATIC BARBECUE-GRILLE CLEANER

[76] Inventor: Steven J. Beke, 150 Allen, Glendale, Calif. 91201

[21] Appl. No.: 557,244

[22] Filed: Dec. 2, 1983

[51] Int. Cl.[3] ..... A46B 13/00

[52] U.S. Cl. ..... 15/21 R; 15/77

[58] Field of Search ..... 15/21 R, 21 E, 38, 39, 15/77, 256.5

[56] References Cited

U.S. PATENT DOCUMENTS

| | | | |
|---|---|---|---|
| 525,574 | 9/1894 | Arbuckle | 15/256.5 |
| 580,312 | 4/1897 | Harris | 15/77 |
| 3,077,622 | 2/1963 | Murphy | 15/77 |
| 4,112,534 | 9/1978 | Horengen | 15/77 |
| 4,180,884 | 1/1980 | Hess | 15/21 R |
| 4,185,528 | 1/1980 | Andersen | 15/256.5 |
| 4,202,071 | 5/1980 | Scharpf | 15/21 E |

FOREIGN PATENT DOCUMENTS

| | | | |
|---|---|---|---|
| 656439 | 10/1963 | Italy | 15/21 R |

*Primary Examiner*—Edward L. Roberts
*Assistant Examiner*—Arthur D. Dahlberg
*Attorney, Agent, or Firm*—Bruce L. Birchard

[57] ABSTRACT

A liquid-sealable container having a cover portion from which a barbecue-grille to be cleaned is suspended by means of depending compression springs, a body portion including a centrally disposed brush supported from and interlocked with a drivable spindle, the spindle passing through a liquid-sealed rotary joint in the lower surface of the body portion and having a driven element secured to the spindle at the lower extremity thereof and a driving mechanism selectively coupleable to the drive mechanism for causing relative rotation between the grille and the brush, the depending compression springs causing forceful engagement between the brush and the grille to effect cleaning of the grille upon the relative rotation between the grille and the brush.

10 Claims, 1 Drawing Figure

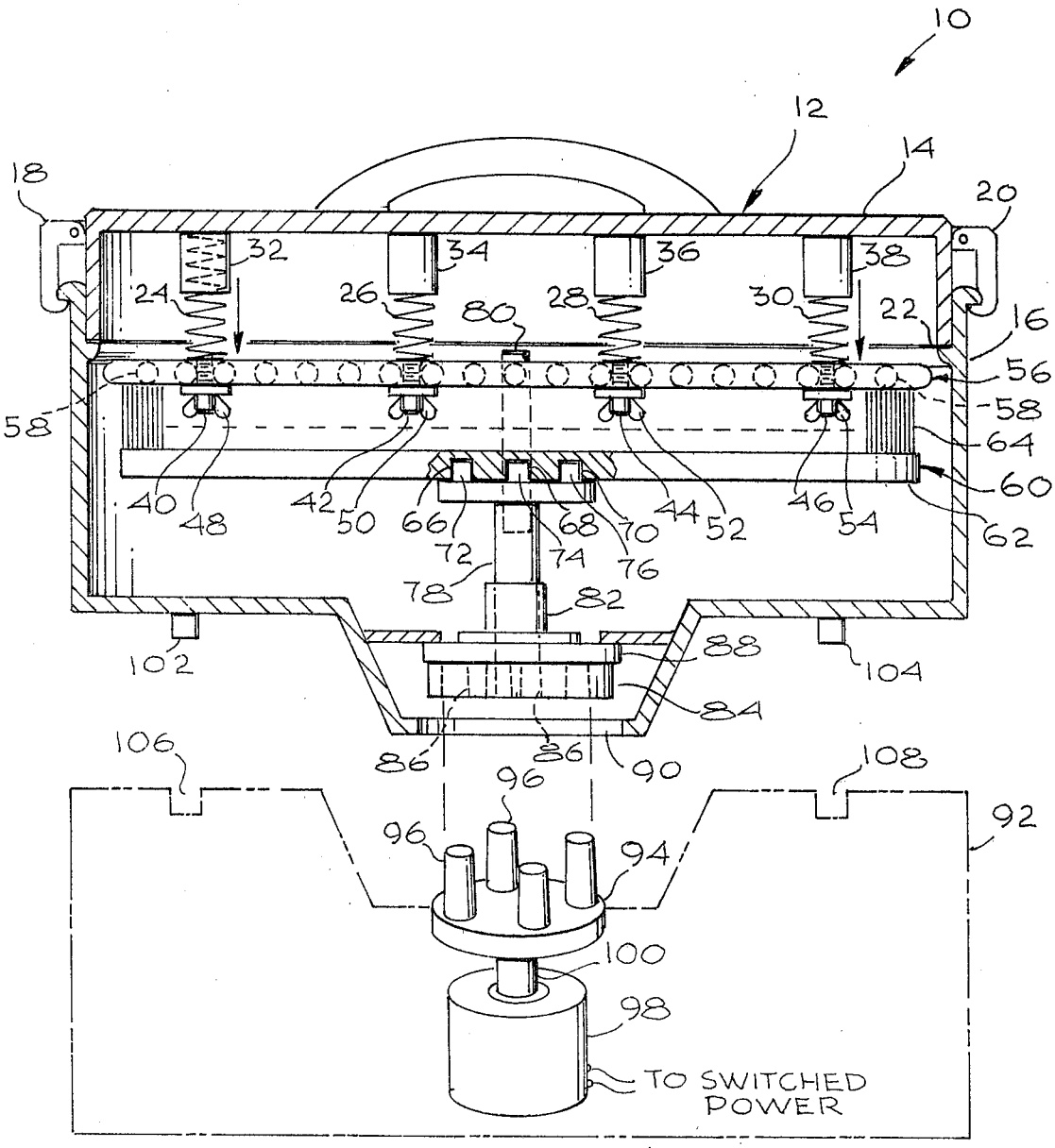
10
12
14
16
18
20
22
24
26
28
30
32
34
36
38
40
42
44
46
48
50
52
54
56
58
58
60
62
64
66
68
70
72
74
76
78
80
82
84
86
86
88
90
92
94
96
96
98
100
102
104
106
108
TO SWITCHED POWER

AUTOMATIC BARBECUE-GRILLE CLEANER

BACKGROUND OF THE INVENTION

1. Field of the Invention

This invention relates to automatic cleaning devices and, more particularly, to devices for cleaning barbecue grilles.

2. Prior Art.

One of the favorite pastimes of Americans, particularly in the summertime, is barbecueing food in the backyard on weekends. As anyone engaged in this pastime knows, the most unpleasant part of barbecueing is cleaning the barbecue grille. The usual procedure is to take the greasy and dirty grille into the kitchen sink and therein to apply various kinds of detergents and elbow-grease to remove the various deposits which are firmly attached to the grille as a result of the high temperatures achieved during the grilling process.

To date, no convenient way to clean grille bars has appeared in the marketplace.

A search of the patent art has revealed nothing which is anticipatory of the invention herein claimed but for record purposes the patents which were found in the search are as follows:

U.S. Pat. No. 525,574 (Arbuckle) issued Sept. 4, 1894 for a wheel washing device;

U.S. Pat. No. 580,312 (Harris) issued Apr. 6, 1897 for a brush machine for cleaning metallic bars or plates;

U.S. Pat. No. 3,077,622 (Murphy) issued Feb. 19, 1963 for a record cleaner;

U.S. Pat. No. 4,185,528 (Andersen) issued Jan. 29, 1980 for cleaning apparatus for disc cutter; and, U.S. Pat. No. 4,202,071 (Scharpf) issued May 13, 1980 for apparatus for washing and drying phonograph records.

None of the devices disclosed in the cited patents affords any relief to the week-end barbecuer, or his wife. The nearest of the cited patents to the device which is shown and claimed herein is the Harris U.S. Pat. No. 580,312. The structure of that patent involves a pair of brushes between which the bars to be cleaned are placed. The scrubbing action is a longitudinal one, not a rotary one, and the structure is large and cumbersome and not applicable to the normal household environment where barbecue-grilles are found. Actually, the brush machine of Harris is not directed to cleaning grilles, at all, but rather, is addressed to cleaning metallic bars or plates while still hot and before being rolled.

Therefore, it is an object of this invention to provide a barbecue-grille cleaning machine which will be free of the problems residing in the machines of the prior art.

It is a further object of this invention to provide a barbecue-grille cleaning machine or cleaner, which is compact, inexpensive and convenient to use.

SUMMARY OF THE INVENTION

A liquid-sealable container is provided with a cover portion which can be locked into a liquid-sealed condition on a lower or body portion of the container, the cover portion having a plurality of depending compression springs from which a barbecue-grille to be cleaned is suspended utilizing a plurality of retaining nuts which cooperate with screws or threaded rods, each affixed to the lower end of one of the compression springs and having a diameter such that it can pass through the space between adjacent ones of the bars in the barbecue-grille. The lower or body portion of the liquid-sealable container has a centrally disposed brush supported from and mechanically interlocked with a drivable spindle, the spindle passing, at its lower end, through a liquid-sealed rotary joint in the lower surface of the body portion and having, at its lowermost extremity, a driven element secured to the spindle, such driven element having sockets therein.

The barbecue-grille cleaner according to this invention also has a base portion which has, extending from the upper surface thereof, a driving element having a plurality of protrusions designed to cooperate with the sockets in the driven element and having means for rotating the driving element, for example on an electric motor, although mechanical hand-crank means could be provided.

The liquid-sealable container and the base portion are cylindrical in configuration and have cooperating male and female keying regions to assure that the container remains fixed in position with respect to the base and that only the internal brush and the means driving the brush will rotate during operation of the machine.

The compression springs which are supporting the barbecue-grille to be cleaned are also designed to force the barbecue-grill into firm contact with the brush so that when the brush rotates it cleans the bars of the barbecue-grille. The automatic barbecue-grille cleaner according to my invention is compact by reason of the cylindrical nature of the container and the rotary motion of the brush with respect to the barbecue-grille bars, and by reason of the single-sided nature of the brushing action. Further, the machine according to my invention can be easily disassembled for cleaning. Further, the driving means is isolated from the cleaning portion of the machine so as to eliminate any need for cleaning the driving or base portion when the process of cleaning a barbecue-grille is completed.

BRIEF DESCRIPTION OF THE DRAWINGS

This invention and its mode of operation can best be understood by the description which follows taken in conjunction with the drawings, in which:

The sole FIGURE is a schematic mechanical diagram representing an elevational view, partially cutaway, of an automatic barbecue-grille cleaner according to my invention.

DETAILED DESCRIPTION OF THE PREFERRED EMBODIMENT

In the sole FIGURE, automatic barbecue-grille cleaner 10 includes container 12 which has a cover portion 14 and a body portion 16. Both of the cover and body portions are cylindrical in configuration. During actual operation of automatic barbecue-grille cleaner 10, cover 14 is secured to body portion 16 by means of clamps 18 and 20 which produce a liquid seal at joint 22. A gasket, not shown, may also be provided as an interposing element between cover portion 14 and body portion 16. Cover portion 14 has, depending from the inner surface thereof, a plurality of compression springs 24, 26, 28 and 30 which are secured at their upper ends to cover portion 14 and are guided over a part of the length of each of such springs by tubes 32, 34, 36 and 38, respectfully. The tubes 32 through 38 assure proper guidance of their respective springs so that the springs do not buckle and the force from each of the springs is directed downwardly, only. The lower ends of springs 24, 26, 28 and 30 terminate in threaded rods 40, 42, 44 and 46, respectfully. The lower ends of each of the springs may be secured to its respective threaded rod by means of welding, or the like.

Retaining nuts 48, 50, 52 and 54 are threaded and designed to cooperate with threaded rods 40, 42, 44 and 46, respectfully. Retaining nuts 48, 50, 52 and 54 are designed to have a diameter which is greater than the center-to-center spacing of bars in any barbecue-grille to be cleaned.

in the sole FIGURE, a barbecue-grille 56 is shown in position for cleaning. Barbecue-grille 56 has bars 58 spaced from and parallel to each other across the diameter of grille 56.

A brush element 60 having a base 62 and a cleaning element 64 distributed over the surface thereof is forcefully engaged by barbecue-grille 56 as a result of the pressure applied from springs 24, 26, 28 and 30, during operation of this invention. Cleaning elements 64 may be hog bristles or may be even more abrasive materials, such as steel bristles, because of the rugged nature of barbecue-grilles and the need for highly abrasive contact with the grilles in order to effect cleaning.

Base portion 62 of brush 60 has a plurality of sockets 66, 68 and 70, therein, the purpose of which is to receive pins 72, 74 and 76 found at the upper extremity of spindle 78. As a result of interlocking of sockets 66, 68 and 70 with pins 72, 74 and 76, rotation of spindle 78 produces rotation of brush 60. Spindle 78 has an extension 80 which passes through brush 60 and serves to assist in the centering of brush 60 on spindle 78 when brush 60 is being installed. Various sizes of brushes may be utilized and the material of the cleaning elements may also be varied.

The lower end of spindle 78 passes through a liquid-sealed rotary joint 82 and terminates in a driven element 84 which includes a plurality of sockets 86. Rubber washer or gasket 88 may be provided as part of the liquid-sealed rotary joint. Driven element 84 faces downwardly through an opening 90 in the bottom of body portion 16.

Base portion 92 contains the means for producing rotary motion of spindle 78. That means includes driving element 94 which has pins 96 extending from the upper surface thereof for engagement with sockets 86 in driven element 84 at the lower extremity of spindle 78. Driving element 94 is caused to rotate by, for example, an electrical motor 98, the shaft 100 of which is concentrically connected to driving element 94 for causing rotary motion thereof. It should be understood that, of course, motor 98 may be replaced by hand-crank means for causing rotation of driving element 94.

To assure that container 12 remains stationary with respect to base 92 during operation of the barbecue-grille cleaner, keying pins 102 and 104 are provided on the bottom of body 16 and similarly placed and sized sockets 106 and 108 are provided on the upper surface of base 92.

The rotary joint 82 is of the type provided in washing machines or blenders and need not be described at length here.

To operate the barbecue-grille cleaner according to my invention, latches or clamps 18 and 20 are released so that cover portion 14 may be removed from body portion 16. Cover portion 14 is placed upside-down on a surface for application or removal of barbecue-grille 56 thereto or therefrom. To remove barbecue-grille 56 from cover portion 14, the retaining nuts 40, 42, 44 and 46 are turned in such a direction that they move off of their respective threaded rods and barbecue-grille 56 may then be removed from those threaded rods for re-use in the barbecue apparatus. Conversely, when a dirty barbecue-grille is to be cleaned, cover portion 14 is placed upside-down on a relatively flat surface and the threaded rods 40, 42, 44 and 46 are passed between appropriate barbecue-grille rods and retaining nuts 48, 50, 52 and 54 are applied to the respective threaded rods for retention of the barbecue-grille.

Cover portion 14 is then repositioned in line with and in contact with body portion 16 of barbecue-grille cleaner 10 and latches 18 and 20 are snapped shut so as to secure cover portion 14 to body portion 16. The lengths of springs 24, 26, 28 and 30 are chosen so that, with cover portion 14 in position on body portion 16, barbecue-grille 56 is firmly engaged by cleaning elements or bristles 64 of brush 60. The entire assembly, namely container 12, is then placed in position on base 92 so that keys 104 and 105 engage sockets 106 and 108, respectively, and driving pins 96 engage sockets 86. It should be noted that pins 96 may be tapered so as to make their engagement with sockets 86 easier for the user.

When the power to motor 98 is switched on, hot water and detergent having been inserted in a body 16 before the application of cover portion 14, thereto, brush 60 is caused to rotate and its cleaning elements 64 scrub the rods 58 in barbecue-grille 56. The length of cleaning members 64 and their rigidity is chosen so that the members 64 pass through the spaces between adjacent grille-rods and clean those rods. Experience shows that one side of the barbecue-grille rods becomes more encrusted than the other side and so the appropriate choice of the side which is downward should be made. If desired, the grille may be turned over and reprocessed in the barbecue-grille cleaner for the ultimate in cleanliness.

If desired, a heating element may be provided in container 12 to heat the water and detergent mixture therein during operation of the barbecue-grille cleaner.

Thus, there has been provided an automatic barbecue-grille cleaner or cleaning machine which is compact, easy to handle, effective and novel.

While a particular embodiment of my invention has been shown and described it will be apparent to those skilled in the art that modifications and variations may be made therein without departing from the spirit and scope of my invention. It is the intention of the appended claims to cover all such modifications and variations.

I claim:

1. A barbecue-grille cleaner including:

a liquid-sealable container, said liquid-sealable container having a cover portion and a body portion; and, a base adapted to receive said container;

said cover portion having suspension means for supporting a barbecue-grille in non-rotatable relationship therewith when said barbecue-grille is to be cleaned;

said body portion having a bottom;

a liquid-sealed rotary joint supported centrally in said bottom;

a spindle passing through and rotatably supported in said rotary joint;

said spindle having first and second ends, said first end terminating in a brush-receiving coupler, said second end terminating in a driven element, said driven element including a plurality of sockets exposed for receiving driving pins;

said base including a driving element rotatably supported centrally therein, said driving element having a plurality of driving pins therein sized and positioned to cooperate with said sockets in said driven element when said container is received by said base;

said body portion including, in addition, a brush having a base portion and a cleaning element portion;

said base portion being adapted to engage said brush-receiving coupler of said spindle centrally of said base portion;

said cleaning element portion extending upwardly from said base portion for engagement with a barbecue-grille to be cleaned;

the length of said suspension means being such that said barbecue-grille to be cleaned engages said cleaning member of said brush forcefully when said cover portion carrying said barbecue-grille is in operating engagement with said body portion of said container.

2. Apparatus according to claim 1 in which said suspension means includes compression springs.

3. Apparatus according to claim 2 in which said compression springs are laterally confined by tubes supported from said cover.

4. Apparatus according to claim 1 in which said suspension means includes compression springs and retainer nuts, said compression springs terminating in threaded rods sized and threaded to receive said retainer nuts.

5. Apparatus according to claim 1 in which said base includes, in addition, rotating means coupled to said driving element.

6. Apparatus according to claim 5 in which said rotating means is an electrical motor.

7. Apparatus according to claim 1 in which said driving pins are tapered.

8. Apparatus according to claim 1 including, in addition, means for clamping said cover portion to said body portion.

9. Apparatus according to claim 1 in which said bottom of said body portion has keying elements depending therefrom.

10. Apparatus according to claim 1 in which said body portion has keying elements depending from said bottom thereof and said base has a top, said top having sockets therein saized and positioned to receive said keying elements depending from said bottom of said body portion.

* * * * *